US010690399B2

(12) United States Patent
Kim

(10) Patent No.: US 10,690,399 B2
(45) **Date of Patent: *Jun. 23, 2020**

(54) REFRIGERATOR AND METHOD FOR CONTROLLING A REFRIGERATOR

(71) Applicant: LG ELECTRONICS INC., Seoul (KR)

(72) Inventor: Yonghyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/459,901

(22) Filed: Jul. 2, 2019

(65) Prior Publication Data

US 2019/0323762 A1 Oct. 24, 2019

Related U.S. Application Data

(63) Continuation of application No. 15/862,754, filed on Jan. 5, 2018, now Pat. No. 10,386,113.

(30) Foreign Application Priority Data

Jan. 9, 2017 (KR) ..... 10-2017-0002803

(51) Int. Cl.
*F25D 23/12* (2006.01)
*F24H 9/20* (2006.01)
*F24H 1/10* (2006.01)

(52) U.S. Cl.
CPC ..... *F25D 23/126* (2013.01); *F24H 1/102* (2013.01); *F24H 9/2028* (2013.01); *F25D 2323/122* (2013.01)

(58) Field of Classification Search
CPC ..... F25D 23/126; F25D 2323/122; F25D 2700/16; F25D 2400/02; F25D 31/005;
(Continued)

(56) References Cited

U.S. PATENT DOCUMENTS 3,021,685 A * 2/1962 Gore ..... G07F 13/065 62/89
4,076,145 A * 2/1978 Zygiel ..... B67D 1/0027 222/1

(Continued)

FOREIGN PATENT DOCUMENTS

JP 04123790 4/1992
KR 10-2004-0058886 7/2004

(Continued)

OTHER PUBLICATIONS

European Search Report dated Jun. 7, 2018 issued in Application No. 18150534.8.

(Continued)

*Primary Examiner* — Kun Kai Ma
(74) *Attorney, Agent, or Firm* — Ked & Associates LLP

(57) ABSTRACT

A refrigerator that may include a cabinet to define a storage space, a door to open and close the storage space, a dispenser provided in the door to dispense hot water, a hot water tank through which water flows so as to heat water introduced into the door, a heater provided in the door to heat the hot water tank, a water inflow passage through which water is supplied to the hot water tank, a water discharge passage guiding hot water discharged from the hot water tank to the dispenser, a flow rate sensor provided in the water inflow passage to measure a flow rate of water flowing through the water inflow passage, a water inflow valve provided in the water inflow passage to adjust a flow of water in the water inflow passage, a water discharge valve provided in the water outlet passage, an input provided in the door to input a temperature of the hot water to be dispensed and a hot water dispensing command, and a controller to control the water inflow valve and the water discharge valve.

20 Claims, 6 Drawing Sheets

(58) Field of Classification Search
CPC ..... F25D 29/00; F25D 23/04; F25D 23/028; B67D 1/1277; B67D 1/1206; B67D 1/0895
See application file for complete search history.

(56) References Cited

U.S. PATENT DOCUMENTS

| | | | | |
|---|---|---|---|---|
| 5,006,689 | A * | 4/1991 | Kurachi | F24H 1/142 122/13.01 |
| 5,680,663 | A * | 10/1997 | Mitchell | C08B 30/16 127/28 |
| 7,027,189 | B2 * | 4/2006 | Umeda | G06K 15/02 358/3.03 |
| 7,207,189 | B2 * | 4/2007 | An | B01D 35/18 62/339 |
| 8,025,186 | B2 * | 9/2011 | Lee | B67D 1/0857 222/146.6 |
| 8,397,952 | B2 * | 3/2013 | Kim | F25D 23/126 222/146.1 |
| 9,889,478 | B2 * | 2/2018 | Chase | B08B 9/027 |
| 2007/0251261 | A1 * | 11/2007 | Son | F25D 23/063 62/390 |
| 2008/0271596 | A1 * | 11/2008 | Kawabuchi | F15B 11/044 91/468 |
| 2009/0159611 | A1 * | 6/2009 | Roetker | B67D 1/0858 222/1 |
| 2009/0218296 | A1 * | 9/2009 | King | C02F 1/008 210/744 |
| 2009/0249821 | A1 * | 10/2009 | Zentner | F24H 1/103 62/389 |
| 2013/0108249 | A1 * | 5/2013 | Krause | B67D 3/0022 392/465 |
| 2014/0230481 | A1 * | 8/2014 | Yun | F25D 23/126 62/340 |
| 2014/0270724 | A1 * | 9/2014 | Hall | B67D 7/82 392/341 |
| 2014/0270725 | A1 * | 9/2014 | Bertolini | B67D 7/82 392/341 |
| 2015/0053302 | A1 * | 2/2015 | Willis | F25C 5/22 141/1 |
| 2015/0225225 | A1 * | 8/2015 | Tae | B67D 1/0858 222/146.2 |
| 2015/0225226 | A1 * | 8/2015 | You | B67D 1/0895 222/54 |
| 2017/0019952 | A1 * | 1/2017 | Kim | H05B 6/365 |
| 2017/0343275 | A1 * | 11/2017 | Kim | B67D 1/0009 |
| 2018/0057344 | A1 * | 3/2018 | Shin | F24H 1/121 |

FOREIGN PATENT DOCUMENTS

| | | |
|---|---|---|
| KR | 10-2007-0105809 | 10/2007 |
| KR | 10-2011-0048882 | 5/2011 |

OTHER PUBLICATIONS

Korean Office Action dated Aug. 21, 2018 issued in Application No. 10-2017-0002803.
U.S. Office Action issued in U.S. Appl. No. 15/862,754 dated Nov. 1, 2018
U.S. Notice of Allowance issued in U.S. Appl. No. 15/862,754 dated Apr. 3, 2019.

* cited by examiner

REFRIGERATOR AND METHOD FOR CONTROLLING A REFRIGERATOR

CROSS-REFERENCE TO RELATED APPLICATION(S)

The present application is a Continuation Application of U.S. application Ser. No. 15/862,754, filed Jan. 5, 2018, which claims priority under 35 U.S.C. 119 and 35 U.S.C. 365 to Korean Patent Application No. 10-2017-0002803, filed in Korea on Jan. 9, 2017, which are hereby incorporated by reference in their entirety.

BACKGROUND

1. Field

A refrigerator and a method for controlling a refrigerator are disclosed herein.

2. Background

Refrigerators are home appliances that store food or other items (hereinafter "food") at a low temperature. Such a refrigerator may include one or more of a refrigerating compartment that stores food in a refrigerated state and a freezing compartment that stores food in a frozen state.

In recent years, a dispenser has been mounted on a front surface of a door of the refrigerator to dispense drinking water, such as hot water or cold water, through the dispenser without opening the refrigerator door. Also, an ice maker that makes ice cubes and stores the cubes has been disposed on the refrigerator door or in the storage compartment. Thus, ice cubes may be dispensed through the dispenser.

A refrigerator including a water supply device is disclosed in Korean Patent Publication No. 2011-0048882, published on May 12, 2011 and hereby incorporated by reference, which is related art. The disclosed refrigerator according to the related art includes a main body in which a cooling chamber is provided, a door that opens and closes the cooling chamber, and a water supply device provided in the door.

The water supply device includes a hot water tank, a heating unit or heater, a water supply tube that supplies water to the hot water tank, a valve provided in the water supply tube, and a hot water pump that adjusts discharge of the hot water. The opening and closing of the valve may be controlled to adjust a water level of the hot water tank. Also, when a hot water dispensing signal is input, the controller compares a hot water temperature detected by a hot water temperature detection unit or detector to a set or predetermined temperature set by a temperature setting part. When a difference between the two temperatures is less than a reference value, the controller controls the hot water pump to allow hot water of the hot water tank to be pumped. The controller controls the driving of the pump to stop the dispensing of the hot water when the difference between the two temperatures is above the reference value.

However, according to the related art, as the opening and closing of the valve of the water supply tube is controlled to adjust the water level, it may be difficult to continuously dispense the hot water. Also, the temperature of the hot water, which is detected by the hot water temperature detection unit and the set temperature, which is set by the temperature setting part, are compared to each other. Then, when the difference between the two temperatures is above the reference value, the dispensing of the hot water is stopped. Thus, it is difficult to dispense an amount of hot water, which is desired by a user. That is, the dispensing of the hot water may be stopped while the hot water is dispensed. Also, as the hot water is dispensed while adjusting the water level of the hot water of the hot water tank, it may be difficult to quickly dispense the hot water.

BRIEF DESCRIPTION OF THE DRAWINGS

Embodiments will be described in detail with reference to the following drawings in which like reference numerals refer to like elements, and wherein.

DETAILED DESCRIPTION

Figure 1:
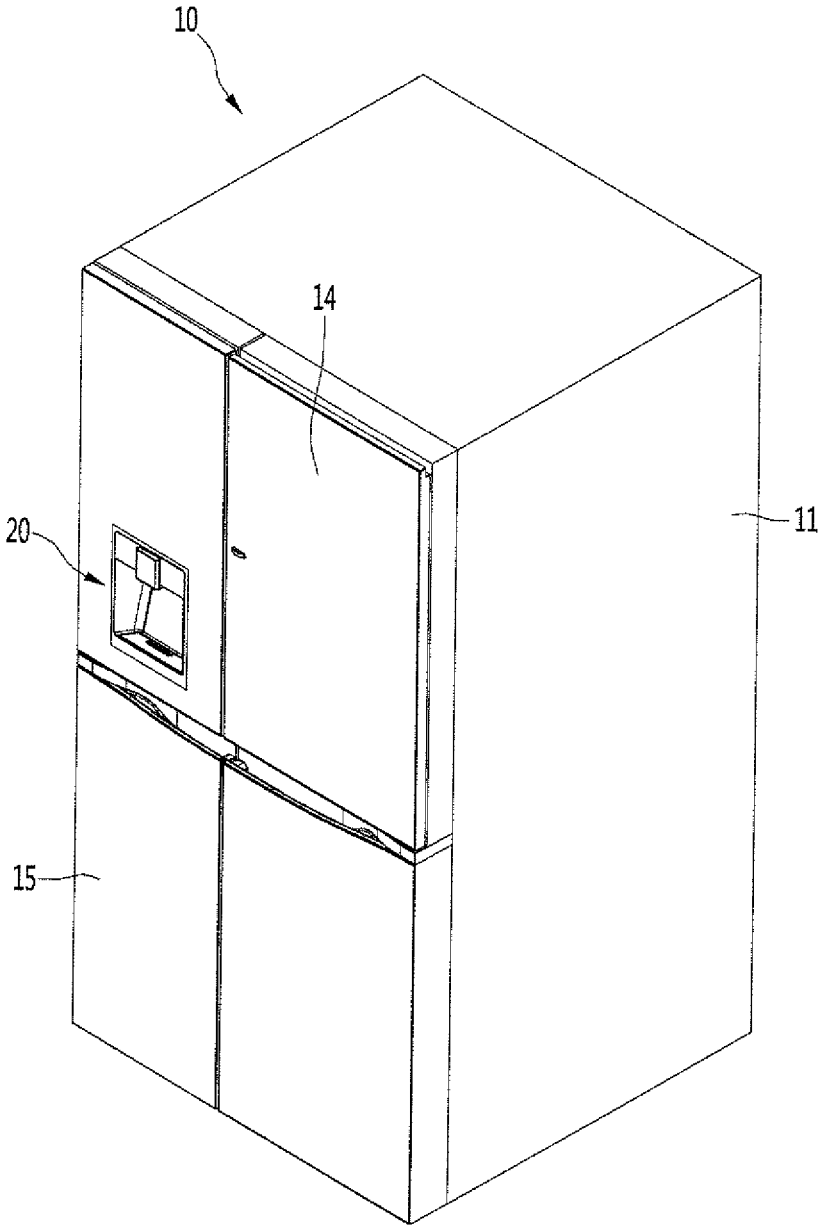
FIG. 1 is a perspective view of a refrigerator according to an embodiment.
Figure 2:
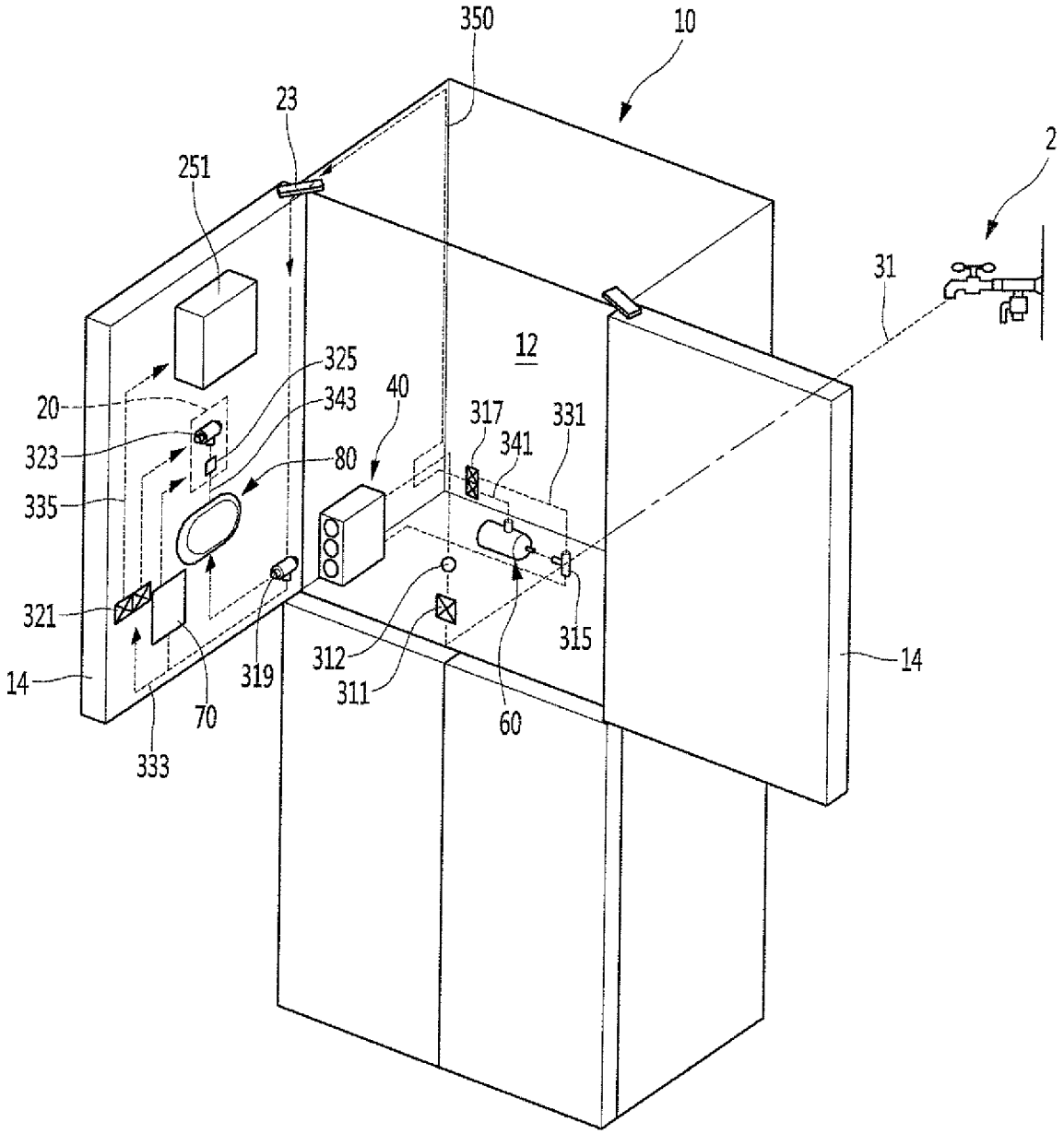
FIG. 2 is a schematic view illustrating an arrangement of a passage through which water flows in the refrigerator according to an embodiment.
Figure 3:
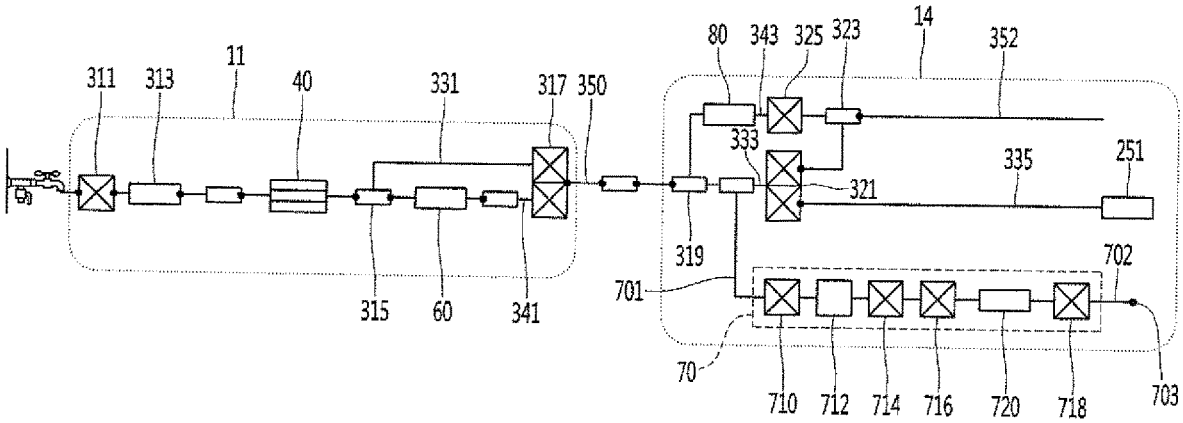
FIG. 3 is a view illustrating an arrangement of a water tube in the refrigerator.
Figure 4:
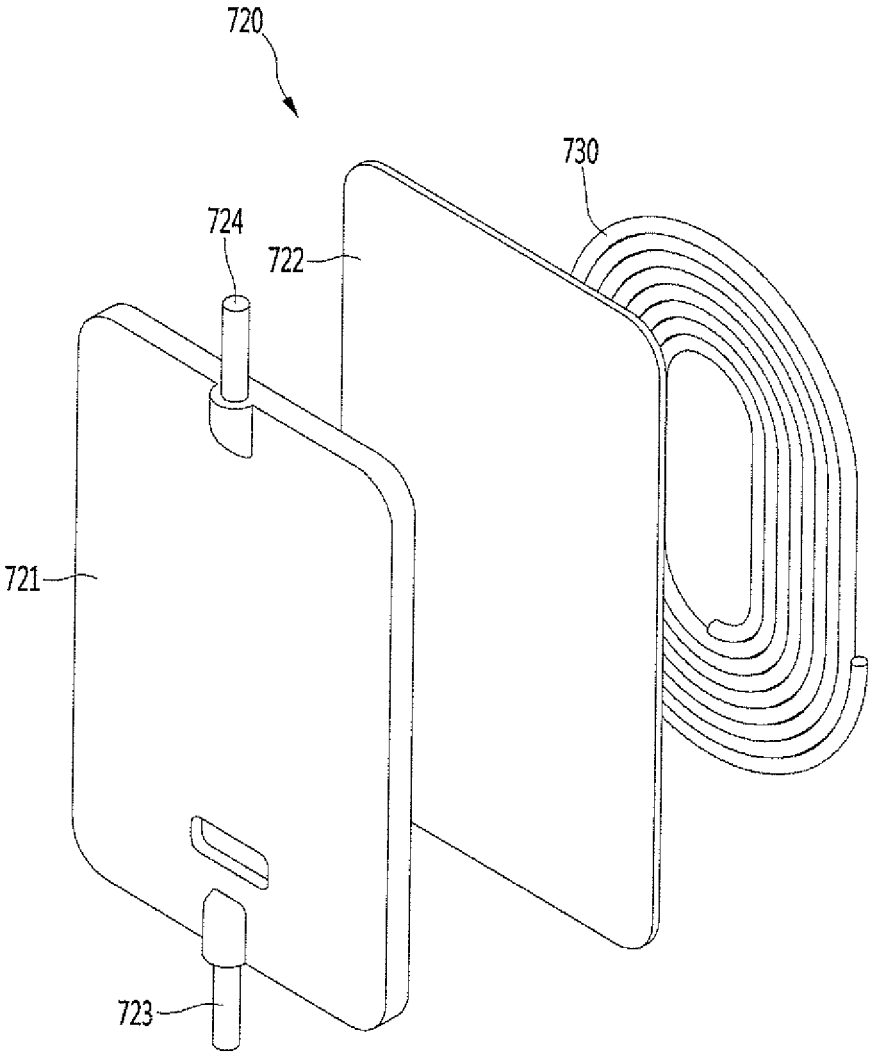
FIG. 4 is a perspective view of a hot water tank and a heater.

FIG. 1 is a perspective view of a refrigerator according to an embodiment. FIG. 2 is a schematic view illustrating an arrangement of a passage through which water flows in the refrigerator according to an embodiment. FIG. 3 is a view illustrating an arrangement of a water tube in the refrigerator. FIG. 4 is a perspective view of a hot water tank and a heater.

Referring to FIGS. 1 to 4, a refrigerator 10 according to an embodiment may include a cabinet 11 that defines a storage space and a door that opens and closes the storage space of the cabinet 11. The storage space may include a refrigerating compartment 12 and a freezing compartment (not shown). The door may include a refrigerating compartment door 14 that opens and closes the refrigerating compartment 12 and a freezing compartment door 15 that opens and closes the freezing compartment.

The refrigerating compartment door 14 and the freezing compartment door 15 may rotate to open and close the refrigerating compartment 12 and the freezing compartment, respectively. Both the refrigerating compartment door 14 and the freezing compartment door 15 may be rotatably coupled to the cabinet 11 by a hinge device or hinge 23. The refrigerating compartment door 14 may be a French type door in which a pair of doors disposed on both left and right or lateral sides independently rotates. Alternatively, the freezing compartment door 15 may open and close the freezing compartment in a sliding manner.

A dispenser 20 and an ice maker 251 may be provided in the refrigerating compartment door 14 disposed on or at one side of the pair of refrigerating compartment doors 14. The dispenser 20 may be disposed on a front surface of the refrigerating compartment door 14 to dispense at least one of water or ice cubes through a user's manipulation at an outside.

An ice making chamber (not shown) may be provided above the dispenser 20 in the refrigerating compartment door 14, and the ice maker 251 may be accommodated in the ice making chamber. The ice making chamber may be opened and closed by a separate ice making chamber door.

Also, although not shown, the ice making chamber may communicate with the freezing compartment by a cooling air duct to receive cool air required for making ice cubes from a freezing compartment evaporator (not shown) in a state in which the refrigerating compartment door 14 is closed.

The refrigerator 10 may purify, cool, or heat water supplied from an external water supply source 2 to dispense the purified, cooled, or heated water through the dispenser 20. The refrigerator 10 may be connected to the water supply source 2 by a water supply passage 31.

The refrigerator 10 may further include a water supply valve 311 and a main body flow rate sensor 313, which are provided in the water supply passage 31, The supply of water from the water supply source 2 may be adjusted by the opening and closing of the water supply valve 311. The main body flow rate sensor 313 may measure a flow rate of water supplied from the water supply source 2. Also, if necessary, the main body flow rate sensor 313 may be integrated with the water supply valve 311. The water supply valve 311 may be provided in or at a rear surface of the cabinet 11 or a machine room in which a compressor is provided. Alternatively, the main body flow rate sensor 313 may measure a flow rate of cool water or purified water, which is dispensed.

The refrigerator 10 may further include a water purifying device or purifier 40 that purifies water supplied from the water supply source 2. The water purifier 40 may include a plurality of filters that purifies the supplied water.

For example, the plurality of filters may be disposed to be vertically stacked within the refrigerating compartment 12. As the plurality of filters is vertically stacked, a space of the refrigerating compartment 12 may be efficiently utilized. Also, even though water leakage occurs in the water purifying purifier 40 as only a narrow area within the refrigerating compartment 12 is contaminated, an efficient and safety space may be realized.

According to an embodiment, three filters may be provided, for example. For example, the plurality of filters may include a pre-carbon filter, a post-carbon filter, and a membrane filter disposed between the pre-carbon filter and the post-carbon filter. Although a number and kind of filters are not limited in this embodiment, the number of filters may be provided to be accommodated in the water purifier 40, and various kinds of functional filters different from each other may be applied to efficiently purify the water.

The refrigerator 10 may further include a first branch part or branch 315 disposed at an outlet-side of the water purifier 40, a main body cold water passage 341 connected to the first branch 315, and a main body purified-water passage 331 connected to the first branch 315. Thus, water discharged from the water purifier 40 may flow to be divided into the main body cold water passage 341 and the main body purified-water passage 331 by the first branch 315.

A main body water tank 60 may be provided in the main body cold water passage 341. For example, the main body water tank 60 may have a cylindrical shape and be disposed in the refrigerating compartment 12.

The refrigerator 10 may further include a main body valve 317 through which the main body cold water passage 341 and the main body purified-water passage 331 are connected to each other and a common passage 350 connected to an outlet-side of the main body valve 317. For example, the main body valve 317 may include two inlets and one outlet. The main body purified-water passage 331 and the main body cold water passage 341 may be respectively connected to the two inlets, and the common passage 350 may be connected to the one outlet.

The common passage 350 may extend along an outside of the cabinet 11 after extending out from an inner case defining the refrigerating compartment 12 and then pass through the hinge 23 of the refrigerating compartment door 14 and extend into the refrigerating compartment door 14. The refrigerator 10 may further include a second branch part or branch 319 connected to the common passage 350 which extends into the refrigerating compartment door 14, a door purified-water passage 333 connected to the second branch 319, and a door cold water passage 343 connected to the second branch 319.

The refrigerator 10 may further include a door water tank 80 provided in the door cold water passage 343 and a cold water valve 325 disposed at an outlet-side of the door water tank 80 in the door cold water passage 343.

The door water tank 80 may cool water, which is cooled in the main body water tank 60 and then supplied, again. While the water cooled in the main body water tank 60 flows along the common passage 350, when the water flows via the outside of the cabinet 11, the water may increase in temperature. Thus, the door water tank 80 may cool the water, which increases in temperature, again to dispense the water at a target cold water temperature when the cold water is dispensed.

When the cold water is not dispensed for a long time, water remaining in the common passage 350 outside of the refrigerating compartment 12 may increase in temperature. In this state, when the cold water is dispensed first, the dispensed water may have a temperature that does not satisfy the target cold water temperature. However, when the cold water is dispensed, an adequate temperature of the cold water may be satisfied through additional cooling of the water and mixing with the cooled water in the door water tank 80.

The refrigerator 10 may further include a purified-water valve 321 provided in the door purified-water passage 333 and an ice making passage 335 connected to the purified-water valve 321. The purified water flowing along the door purified-water passage 333 may be dispensed to an outside of the dispenser 20 by the purified-water valve or be supplied to the ice maker 251 along the ice making passage 335.

The refrigerator 10 may further include a connector 323 through which the door purified-water passage and the door cold water passage 343 are connected to each other and a dispensing passage 352 connected to the connector 323. The cold water and the purified water may be dispensed to the outside of the dispenser 20 along the dispensing passage 352.

The connector 323 may include two inlets and one outlet. The door purified-water passage 333 and the door cold water passage 343 may be respectively connected to the two inlets, and the dispensing passage 352 may be connected to the one outlet.

The purified-water valve 321 may be a three-way valve that controls a flow direction of the purified water. Thus, to dispense the cold water, the cold water valve 325 may be opened in a state in which the purified-water valve 321 is closed. On the other hand, to dispense the purified water, the purified-water valve 321 may be opened in a state in which the cold water valve 325 is closed, and also, the purified-water valve 321 may be switched to allow the purified water to flow to the dispensing passage 352.

The refrigerator 10 may further include a hot water passage branched from the door purified-water passage 333 and a hot water supply device 70 that heats water flowing along the hot water passage. The hot water supply device 70 may include a hot water tank 720 through which water supplied from the door purified-water passage 333 may flow and a heating unit or heater 730 that heats water flowing through the hot water tank 720, As the hot water supply device 70 does not receive cold water, but rather, receive hot water, a time period taken to generate hot water in the hot water supply device 70 may be reduced.

The hot water passage may include a water inflow passage 701 that guides water to the hot water tank 720 and a water discharge passage 702 the guides the hot water discharged from the hot water tank 720 to the dispenser 20. The water inflow passage 701 may connect the door purified-water passage 333 to the hot water tank 720.

A hot water dispensing port 703 may be disposed on or at an end of the water discharge passage 702. The hot water dispensing port 703 may be disposed on the dispenser 20.

In one embodiment, the water discharge passage 702 and the hot water supply device 70 may be disposed adjacent to the dispenser 20. When the water discharge passage 702 is disposed adjacent to the dispenser 20, the water discharge passage 702 may decrease in length, and thus, an amount of water influencing an external temperature may decrease. In this case, a phenomenon in which the hot water is decreased in temperature by the water remaining in the water discharge passage 702 while the hot water is dispensed and a phenomenon in which the hot water is decreased in temperature while the hot water flows along the water discharge passage 702 may be prevented from occurring.

The dispensing passage 352 may have a diameter greater than a diameter of the water discharge passage 702. If the water discharge passage 702 has a relatively large diameter, the hot water may decrease in temperature due to the influence of the external temperature while the hot water flows along the water discharge passage 702. Also, when the water discharge passage 702 has a diameter less than the diameter of the dispensing passage 352, an amount of water remaining in the water discharge passage 702 may decrease. Thus, according to an embodiment, the phenomenon in which the hot water is decreased in temperature by the water remaining in the water discharge passage 702 while the hot water is dispensed and the phenomenon in which the hot water is decreased in temperature while the hot water flows along the water discharge passage 702 may be prevented from occurring.

Although not limited, the hot water supply device 70 may be disposed below the dispenser 20. When the hot water supply device 70 is disposed below the dispenser 20, an increase in thickness of the refrigerating compartment door 14 may be prevented.

Also, when the hot water supply device 70 is disposed below the dispenser 20, at least a portion of the water discharge passage 702 connected to the hot water supply device 70 may extend downward to the dispenser 20. In this case, even though the supplying of the hot water is stopped, a phenomenon in which the hot water remaining in the water discharge passage 702 is discharged through the hot water dispensing port 703 may be reduced.

Also, in this embodiment, the water inflow passage 701 may be connected between the purified-water valve 321 and the second branch 319 in the door purified-water passage 333. If the water inflow passage 701 is disposed at an outlet-side of the purified-water valve 321, a portion of the water may be discharged to the dispensing passage 352 or be supplied to the ice maker 251 along the ice making passage 335. However, according to this embodiment, this phenomenon may be prevented.

The hot water tank 720 may provide a passage through which water flows. The hot water tank 720 may include a first body 721 and a second body 722 coupled to the first body 721. When the first body 721 and the second body 722 are coupled to each other, the first body 721 and the second body 722 may provide a passage through which water flows.

The hot water tank 720 may include an inflow port 723 through which water may be introduced and a discharge port 724 through which water may be discharged. The inflow port 723 and the discharge port 724 may be provided in one of the first body 721 or the second body 722.

The heater 730 may be a coil part or coil having a shape which is wound several times. At least a portion of the hot water tank 720 may include a magnetic body so that the hot water tank 720 may be induction-heated by magnetic fields generated by applying current to the coil. That is, at least one of the first body 721 or the second body 722 may be a magnetic body.

To quickly heat water, each of the first body 721 and the second body 722 may be the magnetic body. Also, the coil may be disposed to face one surface of the first body 721 and the second body 722.

According to an embodiment, as the hot water tank 720 itself generates heat by the induction heating, water may come into direct contact with a surface of the hot water tank 720 while flowing along the passage within the hot water tank 720. Thus, a contact area between the water and the hot water tank 720 may increase to quickly heat the water.

Each of the first body 721 and the second body 722 may have a plate shape to increase a contact area with the water. Also, the first body 721 and the second body 722 may be spaced a predetermined distance from each other in a state in which the first body 721 and the second body 722 are coupled to each other to provide a passage through which water flows. In one embodiment, as water comes into contact with each of the bodies 721 and 722 when each of the bodies 721 and 722 is the magnetic body, the contact area between the bodies 721 and 722 and the water may increase to quickly heat the water.

The hot water supply device 70 may further include a pressure reducing valve 710 that reduces a pressure of water to be supplied to the hot water supply device 70. As described above, as the hot water tank 720 is provided by coupling the plurality of bodies 721 and 722, each of which has the plate shape, to each other, if a water pressure is high, the hot water tank 720 may be deformed or damaged.

Although each of the plurality of bodies 721 and 722 may be increased in thickness, in this case, the hot water tank 720 may increase in size, and also, heat generation efficiency due to the induction heating may be reduced. Thus, it may be difficult to quickly generate hot water. Thus, in this embodiment, the water pressure may be reduced by the pressure reducing valve 710 before water is supplied to the hot water tank 720 to prevent the hot water tank 720 from being deformed or damaged.

The hot water supply device 70 may further include a flow rate sensor that measures a flow rate of water flowing along the water inflow passage 701. That is, a door flow rate sensor 712 may measure a flow rate of water supplied to the hot water tank 720.

In a case of the hot water supply device 70 in which the water flowing along the hot water tank 720 is instantaneously heated, a flow rate of water supplied to the hot water tank 720 may be important so as to dispense hot water having a desired temperature. To dispense hot water having a target temperature which is selected by a user, a flow rate of water flowing through the hot water tank 720 and an output of the heater 730 may be determined. The hot water having the target temperature may be dispensed when the flow rate of water supplied to the hot water tank 720 is accurate.

In one embodiment, although the main body flow rate sensor 313 is provided in the cabinet 11, the passage from the main body flow rate sensor 313 to the hot water tank 720 may have a long length. Thus, when a flow rate of water, which is detected by the main body flow rate sensor 313, is used as a flow rate of water introduced into the hot water tank 720, an error in flow rate may occur. Thus, an actual temperature of the dispensed water may be different from a target temperature.

Thus, the door flow rate sensor 712 may be additionally provided in this embodiment. However, the door flow rate sensor 712 may be disposed adjacent to the hot water tank 720 to accurately measure a flow rate of water supplied to the hot water tank 720.

The hot water supply device 70 may further include a water inflow valve 714 that adjusts an introduction of water into the hot water tank 720, The water inflow valve 714 may be an on/off valve that allows water to flow therethrough or blocks a flow of water.

When the water inflow valve 714 is turned on, water of the door purified-water passage 333 may flow along the water inflow passage 701 and then be introduced into the hot water tank 720. On the other hand, when the water inflow valve 714 is turned off, the introduction of the water into the hot water tank 720 may be stopped.

The hot water supply device 70 may further include a flow rate adjustment valve 716 that adjusts a flow rate of the water supplied to the hot water tank 720. In one embodiment, the flow rate adjustment valve 716 may be disposed between the door flow rate sensor 712 and the hot water tank 720. Alternatively, the door flow rate sensor 712 may be disposed between the flow rate adjustment valve 716 and the hot water tank 720.

Alternatively, the flow rate adjustment valve 716 may be disposed between the water inflow valve 714 and the hot water tank 720. The flow rate adjustment valve 716 may be a valve an opening degree of which is adjustable. When the opening degree increases, an amount of water supplied to the hot water tank 720 may increase. When the opening degree decreases, an amount of water supplied to the hot water tank 720 may decrease.

The opening degree of the flow rate adjustment valve 716 may be maintained to a value of zero or more. That is, in a state in which the opening degree of the flow rate adjustment valve 716 is minimized, a minimum amount of water may be supplied to the hot water tank 720.

On the other hand, the flow rate adjustment valve 716 may serve as the water inflow valve 714. That is, the water inflow valve 714 may be omitted, and the opening degree of the flow rate adjustment valve 716 may be adjusted to a range from zero to a maximum value. When the opening degree of the flow rate adjustment valve 716 is zero, water may not flow.

Unlike this embodiment, the door flow rate sensor 712 may be disposed between the water inflow valve 714 and the flow rate adjustment valve 716.

In one embodiment, the water inflow valve 714 may be turned on after a hot water dispensing command is input. As described above, the water inflow valve 714 may be disposed above the hot water tank 720. When the turn-off state is maintained in a hot water dispensing standby state, a pressure of purified water may be prevented from being applied to the hot water tank 720 while the purified water flows along the door purified-water passage 333. Thus, deformation or damage of the hot water tank 720 due to the pressure of the purified water may be prevented.

Also, the water inflow valve 714 may be disposed above the hot water tank 720. When the turn-off state is maintained in the hot water dispensing standby state, a pressure of purified water may be prevented from being applied to the door purified-water passage 333 and the water inflow passage 701 while cold water is dispensed.

The hot water supply device 70 may further include a water discharge valve 718 that adjusts a discharge of hot water from the water discharge passage 702. When the water discharge valve 718 is turned on, water of the hot water tank 720 may flow along the water discharge passage 702 and then be discharged to the outside through the hot water dispensing port 703. On the other hand, when the water discharge valve 718 is turned off, the discharge of the water from the hot water tank 720 may be blocked.

Figure 5:
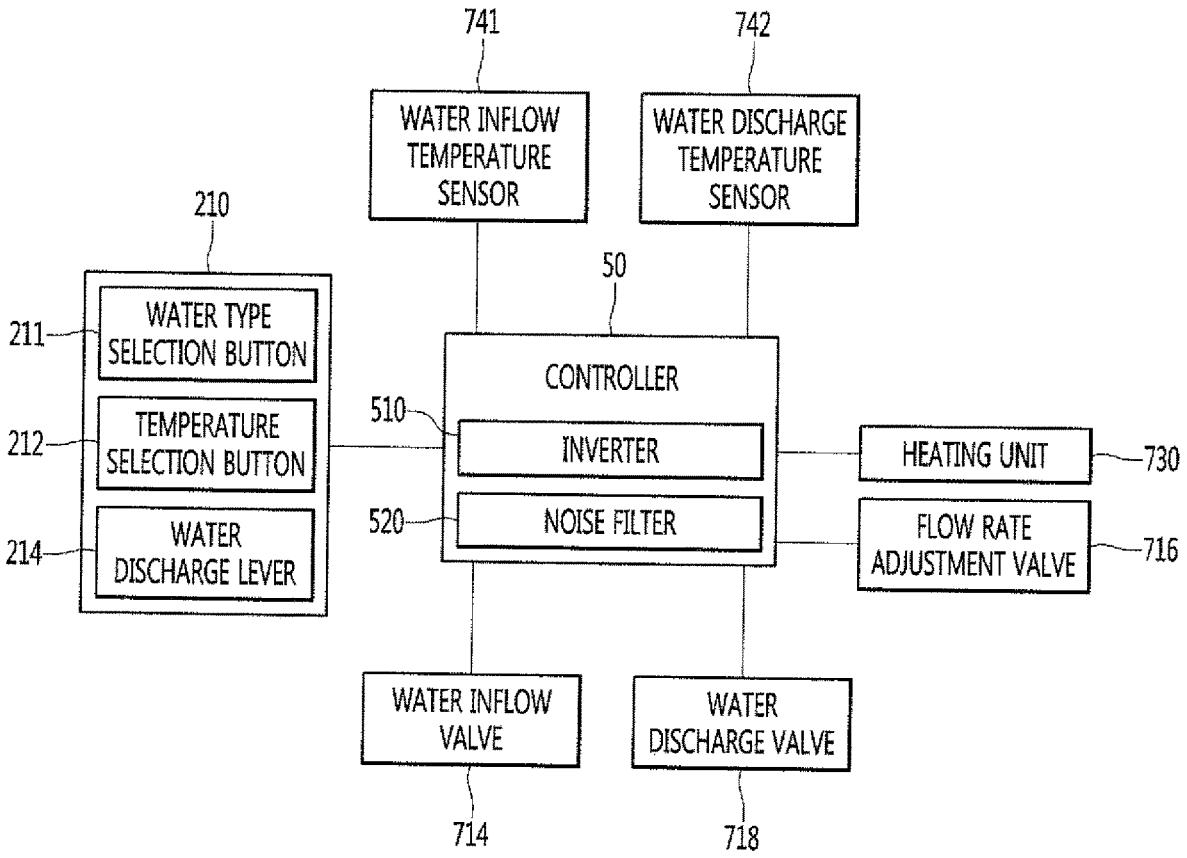
FIG. 5 is a block diagram of the refrigerator according to an embodiment.

FIG. 5 is a block diagram of the refrigerator according to an embodiment. Referring to FIG. 5, the refrigerator 10 may further include an input unit or input 210 that receives input of various commands. For example, the input 210 may be provided in the refrigerating compartment door 14. The input 210 may be provided in the dispenser 20 or be disposed at a position adjacent to the dispenser 20 in the refrigerating compartment door 14.

The input 210 may include a water type selection button 211 for selection of a kind of water to be dispensed. The kind of water including purified water, cold water, and hot water may be selected using the water type selection button 211.

The water type selection button 211 may be provided as a single button to select purified water, cold water, and hot water according to a number of times it is pushed. Alternatively, the water type selection button 211 may include a purified-water button, a cold water button, and a hot water button.

The input 210 may further include a temperature selection button 212 for selection a temperature of hot water to be dispensed. A temperature of water may be selected in plural stages using the temperature selection button 212.

Although not limited, hot water to be dispensed may be selected at a temperature of about 85 degrees, or about 75 degrees, for example, using the temperature selection button 212. A temperature of the water to be dispensed may be previously determined when the refrigerator is manufactured, and a temperature of water to be dispensed by the user may be selected using the temperature selection button 212. Alternatively, the temperature of water to be dispensed by the user may be randomly set or changed.

For example, in the temperature selection button 212, a temperature of hot water to be dispensed may be selected according to a number of times it is pushed. For use convenience of the user, a temperature of hot water, which is preferred by the user, may be basically set to be selected.

For example, when hot water is selected using the water type selection button 211, the hot water may be selected to have a temperature of about 85 degrees. In this state, when the user intends to change a temperature of hot water to be dispensed, the temperature selection button 212 may be selected.

On the other hand, a temperature selection button for each temperature of hot water to be dispensed may be provided. That is, temperatures of hot water to be dispensed may be selected using a plurality of temperature selection buttons, respectively.

Although not shown, the input 210 may further include a dispensing amount selection button for selection of an amount of hot water to be dispensed. The user may dispense a desired amount of hot water using the dispensing amount selection button.

The "button" referred to in this embodiment may be a mechanical button that mechanically operates or a selection part or portion displayed in a touch screen state and capable of being touched by the user.

The input 210 may further include a water discharge lever 214 which may be manipulated by the user to dispense water. When the user selects hot water, cold water, or purified water and manipulates the water discharge lever 214, hot water, cold water, or purified water may be dispensed from the dispenser 20. A lever detection sensor (not shown) that detects manipulation of the water discharge lever 214 may be provided in the refrigerator 10.

The input unit 210 may further include a water discharge button manipulated by the user to dispense water. When the user selects hot water, cold water, or purified water and manipulates the water discharge button, hot water, cold water, or purified water may be dispensed from the dispenser 20.

The refrigerator 10 may further include a water inflow temperature sensor 741 that detects a temperature of water supplied to the hot water tank 720, a water discharge temperature sensor 742 that detects a temperature of water discharged from the hot water tank 720, and a controller 50 that controls the heater 730. The water inflow temperature sensor 741 may be disposed on the water inflow passage 701. To accurately measure a temperature of water supplied to the hot water tank 720, the water inflow temperature sensor 741 may be disposed at a point between the flow rate adjustment valve 716 and the hot water tank 720 in the water inflow passage 701. Alternatively, the water inflow temperature sensor 741 may be provided on the flow rate adjustment valve 716 or in the inflow port 723 of the hot water tank 720.

As described above, due to a position of the water inflow temperature sensor 741, a temperature of water supplied to the hot water tank 720 and a temperature of water detected by the water inflow temperature sensor 741 may be substantially the same. When a distance between the water inflow temperature sensor 741 and the hot water tank 720 increases, the passage through which water flows to the hot water tank 720 may increase in length, and thus, the temperature of the water may be affected by an outside of the passage after the temperature of the water detected by the water inflow temperature sensor 741. However, when the water inflow temperature sensor 741 is disposed to be maximally close to the hot water tank 720, the temperature of the water supplied to the hot water tank 720 may be substantially the same as the temperature of the water, which is detected by the water inflow temperature sensor 741, to improve accurately in detection.

The water discharge temperature sensor 742 may be provided in the water discharge passage 702. Alternatively, the water discharge temperature sensor 742 may be provided in the discharge port 724 or the water discharge valve 718 of the hot water tank 720.

The controller 50 may include an inverter 510. The inverter 510 may control an amount of current applied to the heater 730 to adjust an induction heating amount. That is, an output of the heater 730 may be adjusted by the inverter 510. When the induction heating amount is adjusted as described above, water may be heated at a temperature desired by the user, and thus, hot water having a target temperature set by the user may be dispensed through the hot water dispensing port 703.

When the heater 730 applies a predetermined output to dispense hot water having a set or predetermined temperature, an actual temperature of water dispensed from the hot water tank 720 and a set or predetermined temperature may be different from each other according to the temperature (a temperature of introduced water) supplied to the hot water tank 720. Thus, in one embodiment, the controller 50 may determine a flow rate of water supplied to the hot water tank 720 and an output (an amount of current applied to the coil) of the heater 730 on the basis of the water inflow temperature detected by the water inflow temperature sensor 741 and the selected target temperature.

For example, if the water inflow temperature is high, the controller 50 may set a flow rate to be high, and if the water inflow temperature is low, the controller 50 may set a flow rate to be low. Also, when the target temperature is high, the controller 50 may set the output of the heater 730 per unit time to a high value, and when the target temperature is low, the controller 50 may set the output of the heater 730 per unit time to a low value.

The controller 50 may control the flow rate adjustment valve 716 on the basis of a flow rate detected by the door flow rate sensor 712. For example, although the controller 50 controls the flow rate adjustment valve 716 so that the hot water tank 720 has a reference flow rate, an actual flow rate detected by the door flow rate sensor 712 may be different from the reference flow rate. In this case, the controller 50 may increase or decrease the reference flow rate on the basis of the flow rate detected by the door flow rate sensor 712. The reference flow rate may not be a fixed flow rate, but rather, may be a flow rate calculated through the set target temperature and the water inflow temperature.

Also, the controller 50 may include a noise filter 520. The noise filter 520 may remove noise from a signal containing the noise generated by magnetic fields, which are generated by the current applied to the heater 730.

The noise filter 520 may remove noise from signals output from the water inflow temperature sensor 741, the water discharge temperature sensor 742, and the door flow rate sensor 712. Also, the noise filter 520 may remove noise from a control signal output from the controller 50 and applied to the various valves 714, 718, and 716.

Hereinafter, a process of dispensing water from the refrigerator will be described. First, a process of dispensing cold water will be described hereinafter.

When cold water is selected by the water type selection button 211, and the water discharge lever 214 is manipulated, the controller 50 may determine that a cold water dispensing command is input. When the cold water dispensing command is input, the water supply valve 311 may be turned on. Thus, the common passage 350 may be in a state in which cold water is capable of flowing by the main body valve 317, and then, the cold water valve 325 may be turned on.

As a result, cold water stored in the main body water tank 60 may pass through the main body valve 317 to flow along the common passage 350 and then be introduced into the refrigerating compartment door 14. The cold water flowing through the common passage 350 within the refrigerating compartment door 14 may be introduced into the door cold water passage 343 to flow along the door water tank 80, Also, the cold water may be dispensed to the outside of the dispenser 20 through the dispensing passage 352.

As described above, as the water inflow valve 714 is in the turned-off state while the cold water is dispensed, a pressure of purified water may be prevented from being applied to the hot water tank 720. Also, when a cold water dispensing end command is input (for example, manipulation of the water discharge lever 214 is released), the water supply valve 311 may be closed after the cold water valve 325 is closed.

In this embodiment, as the passage between the cold water valve 325 and the water supply valve 311 is long, when the cold water valve 325 is turned off after the water supply valve 311 is turned off first, water remaining in the passage may be undesirably dispensed through the dispenser 20 even though the cold water dispensing end command is input. However, according to one embodiment, when the cold water dispensing end command is input, the above-described phenomenon may be prevented from occurring when the water supply valve 311 is turned off after the cold water valve 325 is turned off. Alternatively, the water supply valve 311 and the cold water valve 325 may be turned off at the same time.

Next, a process of dispensing purified water will be described hereinafter.

When purified water is selected by the water type selection button 211, and the water discharge lever 214 is manipulated, the controller 50 may determine that a purified-water dispensing command is input. When the purified-water dispensing command is input, purified water may be in a state in which the purified water is capable of flowing to the common passage 350 by the main body valve 317, and the purified-water valve 321 may be turned on. The purified-water valve 321 may operate to allow the door purified-water passage 333 to communicate with the dispensing passage 352.

As a result, the purified water passing through the water purifying device 40 may detour past the main body water tank 60 to pass through the main body valve 317 and then flow along the common passage 350 and be introduced into the refrigerating compartment door 14. The purified water flowing through the common passage 350 within the refrigerating compartment door 14 may be introduced into the door purified-water passage 333. The purified water introduced into the door purified-water passage 333 may pass through the purified-water valve 321 and then be dispensed to the outside of the dispenser 20 through the dispensing passage 352.

As described above, as the water inflow valve 714 is in the turned-off state while the purified water is dispensed, a pressure of the purified water may be prevented from being applied to the hot water tank 720, Also, when a purified-water dispensing end command is input (for example, manipulation of the water discharge lever 214 is released), the water supply valve 311 may be closed after the purified-water valve 311 is closed.

In this embodiment, as the passage between the purified-water valve 321 and the water supply valve 311 is long, when the purified-water valve 321 is turned off after the water supply valve 311 is turned off first, water remaining in the passage may be undesirably dispensed through the dispenser 20 even though the purified-water dispensing end command is input. However, according to one embodiment, when the purified-water dispensing end command is input, the above-described phenomenon may be prevented from occurring when the water supply valve 311 is turned off after the purified-water valve 321 is turned off. Alternatively, the water supply valve 311 and the purified-water valve 321 may be turned off at the same time.

Next, a process of dispensing hot water will be described hereinafter.

Figure 6:
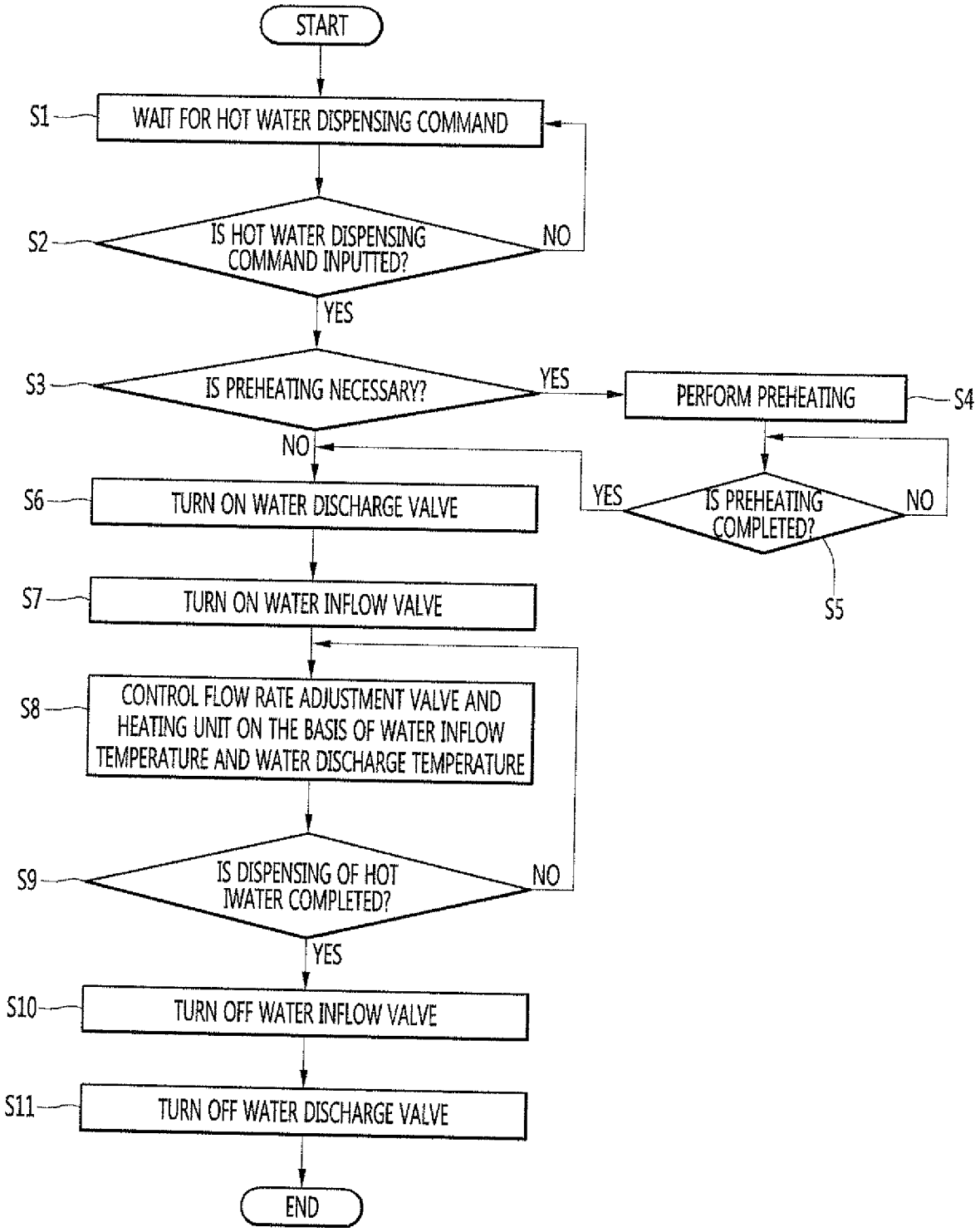
FIG. 6 is a flowchart for explaining a hot water dispensing process according to an embodiment.

FIG. 6 is a flowchart for explaining a hot water dispensing process according to an embodiment. Referring to FIGS. 3 to 6, controller 50 may wait for a hot water dispensing command (S1). The controller 50 may determine whether the hot water dispensing command is input (S2).

For example, the hot water dispensing command may be input by selecting hot water through water type selection button 211 and manipulating water discharge lever 214. In this embodiment, a method for inputting the hot water dispensing command is not limited. Before the hot water dispensing command is input, a target temperature of hot water to be dispensed may be input or selected through input 210, and also, an amount of hot water to be dispensed may be selected through the input 210.

Hereinafter, a case in which water exists in hot water tank 720 will be described.

When the hot water dispensing command is input, the controller 50 may determine whether preheating of the hot water tank 720 is necessary (S3). For example, the controller 50 may determine whether preheating of the hot water is necessary on the basis of a temperature of water existing in the hot water tank 720 and the set target temperature.

The temperature of the water existing in the hot water tank 720 may be determined as the same as the temperature detected by the water discharge temperature sensor 742 or be calculated through the temperature detected by the water discharge temperature sensor 742. Alternatively, although not shown, a separate temperature sensor may be installed on a surface of the hot water tank 720, and whether the preheating is necessary may be determined using the temperature detected by the temperature sensor installed on the hot water tank 720.

For example, the controller 50 may determine whether the temperature within the hot water tank 720 is less than a preheating reference temperature. The preheating reference temperature may be less than the target temperature set by the user and also may vary according to the target temperatures. The preheating reference temperature for each target temperature may be previously stored in a memory (not shown).

When the detected temperature of the water within the hot water tank 720 is less than the preheating reference temperature, the controller 50 may determinate that the preheating of the hot water tank 720 is necessary. On the other hand, when the detected temperature of the hot water tank 720 exceeds the preheating reference temperature, the controller 50 may determine that the preheating of the hot water tank 720 is unnecessary.

As the present temperature of water within the hot water tank 720 is less than a minimum target temperature, or a difference between the present temperature and the minimum target temperature is small, a temperature of water dispensed by adjusting a flow rate while the hot water is dispensed and an output of the heater 730 may be substantially the same as the target temperature.

A case in which the preheating is necessary may be, for example, a case in which an elapsed time after the previous hot water is dispensed is less than a reference time. In this case, as the water within the hot water tank 720 is high, the preheating may be unnecessary. When the preheating is unnecessary, the hot water may be immediately discharged to reduce a hot water discharge time. As the result determined in operation S3, if it is determined that the preheating is necessary, the controller 50 perform a preheating process before the hot water is dispensed (S4).

In this embodiment, water inflow valve 714 and water discharge valve 718 may be maintained in a closed state while the preheating process is performed. Thus, even though the hot water dispensing command is input, water may not be dispensed through hot water dispensing port 703 during the preheating process.

To perform the preheating process, the controller 50 may determine a preheating time until the detected temperature of the water within the hot water tank 720 reaches the set target temperature. The controller 50 may determine a preheating time until the detected water temperature reaches the set target temperature when the heater 730 operates at a predetermined output. Although not limited thereto, the predetermined output may be a maximum output.

As described above, as the preheating time is determined as a time taken until the detected temperature of the water within the hot water tank 720 reaches the set target temperature, the more the detected temperature of the water within the hot water tank 720 is similar to the actual water temperature, the more the preheating time may increase in accuracy.

Also, during the preheating process, the controller 50 may operate the heater 730 at the predetermined output during the determined preheating time. In this embodiment, although not shown, the controller 50 may include a timer that checks an elapsed time. Although not limited, the water discharge flow rate may be zero during the preheating process, and the heater 730 may be uniformly maintained at a maximum output during the preheating time.

In the preheating process, the controller 50 may determine whether the preheating is completed (S5). For example, the controller 50 may determine that the preheating is completed when the temperature of the water within the hot water tank 720 reaches the target temperature. However, this embodiment is not limited to the method for determining whether the preheating is completed.

Thus, the water within the hot water tank 720 may be heated in a state in which the water does not flow to increase in temperature during the preheating process. When the preheating process is ended, a temperature of the water within the hot water tank 720 may increase up to the target temperature.

When it is determined that the preheating is completed in operation S5 or that the preheating is unnecessary in operation S3, the controller 50 may turn on the water discharge valve 718 (S6). Thereafter, the controller 50 may turn on the water inflow valve 714 (S7).

As the pressure of the hot water tank 720 is in the increasing state when the preheating is completed, if the water inflow valve 714 is turned on before the water discharge valve 718 is turned on, the hot water may flow backward to the door purified-water passage 333 by the increasing pressure of the hot water tank 720. Thus, to prevent this phenomenon from occurring, the water discharge valve 718 may be turned on before the water inflow valve 714 is turned on. Alternatively, the water inflow valve 714 and the water discharge valve 718 may be turned on at the same time.

Also, the controller 50 may control the flow rate adjustment valve 716 and the heater 730 on the basis of the water inflow temperature detected by the water inflow temperature sensor 741 and the temperature (water discharge temperature) of the water, which is detected by the water discharge temperature sensor 742. That is, the controller 50 may control a flow rate of water supplied to the hot water tank 720 and an amount of current applied to the heater 730 on the basis of the water inflow temperature and the water discharge temperature. Alternatively, the controller 50 may control the flow rate adjustment valve 716 on the basis of a flow rate detected by the door flow rate sensor 712.

Also, in the process of dispensing hot water, the controller 50 may determine whether the dispensing of the hot water is completed (S9). In this embodiment, the case in which the dispensing of the hot water is completed may be a case in which a hot water dispensing end command is input or a case in which an accumulation amount of dispensed water reaches a reference amount, which is set by the user. The hot water dispensing end command may be a case in which water discharge lever 214 is pushed while the hot water is dispensed. In this embodiment, a method for inputting the hot water dispensing end command is not limited. According to the result determined in operation S9, when the dispensing of the hot water is completed, the controller 50 may turn off the water inflow valve 714 (S10). Then, the controller 50 may turn off the water discharge valve 718 (S11).

The reason the water inflow valve 714 is turned off before the water discharge valve 718 is turned off is to prevent pressures of the water inflow passage 701 and the hot water tank 720 from increasing. If the water discharge valve 718 is turned off before the water inflow valve 714 is turned off, a pressure between the water discharge valve 718 and the water inflow valve 714, that is, a pressure within the hot water tank 720 increases by inertia of water flowing along the water inflow passage 701 even after the water discharge valve 718 is turned off. As described above, when the water inflow valve 714 is closed in a state in which the pressure of the hot water tank 720 increases, the hot water may be suddenly discharged by the high pressure of the hot water tank 720 when the water discharge valve 718 is opened to dispense the hot water. Thus, an amount of dispensed hot water unnecessarily increases.

Also, accuracy in measurement of the flow rate, which is measured by the flow rate sensor 712, may increase when the pressures of the hot water passages 701 and 702 decrease. However, when the hot water is suddenly discharged by the high pressure of the hot water tank 720, the water pressures of the hot water passages 701 and 702 may increase to reduce the accuracy in measurement of the flow rate, which is measured by the flow rate sensor 712. However, when the water inflow valve is turned off before the water discharge valve 718 is turned off, the pressure of the hot water tank 720 and the water pressures of the hot water passages 701 and 702 may be prevented from increasing.

Also, the pressure reducing valve 710 may be disposed above the flow rate sensor 712 so that the water passes through the flow rate sensor 712 in the state in which the water decreases in pressure. That is, the flow rate sensor 712 may be disposed between the pressure reducing valve 710 and the hot water tank 720.

Also, the water inflow valve 714 may be disposed between the pressure reducing valve 710 and the hot water tank 720. In this case, although the water inflow valve 714 breaks down or malfunctions, as the water that decreases in pressure while passing through the pressure reducing valve 710 passes through the water inflow valve 714 and then is supplied to the hot water tank 720, the hot water tank 720 may be prevented from being deformed or damaged.

When the water inflow valve 714 is turned off before the water discharge valve 718 is turned off, water remaining in the water discharge passage 702 may be discharged through the hot water dispensing port 703 even after the dispensing of the hot water is finished. However, in this embodiment, as described above, as the hot water supply device 70 is disposed below the dispenser 20, the water discharge passage 702 may be reduced in length and have a diameter less than a diameter of the dispensing passage 352 to minimize an amount of water remaining in the water discharge passage

702. Thus, after the dispensing of the hot water is finished, an amount of water dispensed through the hot water dispensing port 703 may be minimized.

In the above embodiment, an example in which the hot water supply device is provided in the refrigerating compartment door in the bottom freeze-type refrigerator in which the freezing compartment door is disposed at a lower side, and the refrigerating compartment door is disposed at an upper side is discussed. However, embodiments are not limited thereto. That is, embodiments may be applied to a side by side-type refrigerator in which the freezing compartment door is disposed above the refrigerating compartment door or a top mount-type refrigerator in which the freezing compartment door and the refrigerating compartment door are respectively disposed at left and right or lateral sides. For example, in a case of the side by side-type refrigerator, the hot water supply device and the dispenser may be provided in the freezing compartment door. In this case, the hot water supply device may be disposed below the dispenser in the freezing compartment door.

Embodiments disclosed herein provide a refrigerator in which a pressure of water supplied to a hot water tank is reduced to prevent the hot water tank from being deformed. Embodiments disclosed herein also provide a refrigerator in which deformation of a hot water tank due to an increase in pressure of a hot water passage is prevented while cold water or purified water is dispensed. Embodiments disclosed herein further also provide a refrigerator in which a flow rate of water introduced into a hot water tank is controlled to allow a temperature of dispensed hot water to maximally approach a target temperature and a method for controlling a refrigerator.

Embodiments disclosed herein provide a refrigerator in which a flow rate of water supplied into a hot water tank is accurately measured to dispense a fixed quantity and a method for controlling a refrigerator. Embodiments disclosed herein also provide a refrigerator in which a pressure of a hot water passage is reduced after dispensing of hot water is completed so that the hot water is prevented from being suddenly dispensed when the next dispensing of the hot water is performed and a method for controlling a refrigerator.

Embodiments disclosed herein provide a refrigerator that may include a cabinet to define a storage space; a door to open and close the storage space; a dispenser provided in the door to dispense hot water; a hot water tank through which water may flow so as to heat water introduced into the door; a heating unit or heater provided in the door to heat the hot water tank; a water inflow passage through which water may be supplied to the hot water tank; a water discharge passage to guide hot water discharged from the hot water tank to the dispenser; a flow rate sensor provided in the water inflow passage to measure a flow rate of water flowing through the water inflow passage; a water inflow valve provided in the water inflow passage to adjust a flow of water in the water inflow passage; a water discharge valve provided in the water outlet passage; an input unit or input provided in the door to input a temperature of the hot water to be dispensed and a hot water dispensing command; and a controller to control the water inflow valve and the water discharge valve. The controller may turn off the water inflow valve and the water discharge valve in a hot water dispensing standby state and turn on the water inflow valve and the water discharge valve in a hot water dispensing process.

Embodiment disclosed herein provide a refrigerator that may include a cabinet to define a storage space; a door to open and close the storage space; a dispenser provided in the door to dispense hot water; a hot water tank through which water may flow so as to heat water introduced into the door; a heating unit or heater provided in the door to heat the hot water tank; a water inflow passage through which water may be supplied to the hot water tank; a pressure reducing valve to reduce a pressure of the water flowing through the water inflow passage; a water discharge passage to guide hot water discharged from the hot water tank to the dispenser; a flow rate sensor disposed between the pressure reducing valve and the hot water tank in the water inflow passage to measure a flow rate of the water flowing through the water inflow passage; a water inflow valve provided in the water inflow passage to adjust a flow of water in the water inflow passage; and a water discharge valve provided in the water outlet passage.

Embodiment disclosed herein provide a method for controlling a refrigerator that may include inputting a hot water dispensing command; turning on a water inflow valve disposed at an inlet-side of a hot water tank and a water discharge valve disposed at an outlet-side of the hot water tank, by a controller; determining, by the controller, whether dispensing of hot water is completed; and turning off the water discharge valve after the water inflow valve is turned off when the dispensing of the hot water is completed, by the controller.

The details of one or more embodiments are set forth in the accompanying drawings and the description below. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet to define a storage space;

a door to open and close the storage space;

a dispenser provided in the door to dispense hot water;

a hot water tank through which water flows to heat water introduced into the door;

a heater provided in the door to heat the hot water tank;

a water inflow passage through which water is supplied to the hot water tank;

a water discharge passage to guide hot water discharged from the hot water tank to the dispenser;

a first flow rate sensor provided in the water inflow passage to measure a flow rate of water flowing through the water inflow passage;

a water inflow valve provided in the water inflow passage to adjust a flow of water in the water inflow passage;

a water discharge valve provided in the water discharge passage;

an input provided to input a temperature of the hot water to be dispensed and a hot water dispensing command; and a controller to control the water inflow valve and the water discharge valve, wherein the controller turns off the water inflow valve and the water discharge valve in a hot water dispensing standby state and turns on the water inflow valve and the water discharge valve in a hot water dispensing process, and wherein the controller turns on the water inflow valve to dispense the hot water after the water discharge valve is turned on.

2. The refrigerator of claim 1, wherein, when the hot water dispensing is finished, the controller turns off the water discharge valve after turning off the water inflow valve.

3. The refrigerator of claim 1, further comprising a pressure reducing valve provided in the door to reduce a pressure of the water flowing through the water inflow passage, wherein the first flow rate sensor is disposed in a passage between the pressure reducing valve and the hot water tank so that water passing through the pressure reducing valve passes through the first flow rate sensor.

4. The refrigerator of claim 3, wherein the water inflow valve is disposed in a passage between the pressure reducing valve and the hot water tank in the water inflow passage.

5. The refrigerator of claim 1, further comprising a flow rate adjustment valve provided in the water inflow passage to adjust a flow rate of water introduced into the hot water tank, wherein the controller controls the flow rate adjustment valve on a basis of the flow rate detected by the first flow rate sensor.

6. The refrigerator of claim 5, further comprising:

a water inflow temperature sensor to detect a temperature of water flowing through the water inflow passage; and a water discharge temperature sensor to detect a temperature of water flowing through the water discharge passage, wherein the controller controls the flow rate adjustment valve on a basis of the temperature detected by the water inflow temperature sensor, the flow rate detected by the first flow rate sensor, the temperature detected by the water discharge temperature sensor, and a set target temperature.

7. The refrigerator of claim 1, wherein at least a portion of the hot water tank is made of a magnetic material, and the heater is provided as a coil and disposed to face the hot water tank at an outside of the hot water tank so as to heat water flowing in the hot water tank.

8. The refrigerator of claim 1, wherein a purified-water passage through which purified water to be dispensed from the dispenser flows, is provided in the door, and the water inflow passage is branched from the purified-water passage.

9. The refrigerator of claim 8, further comprising a second flow rate sensor provided in the cabinet to detect a flow rate of water flowing through the purified-water passage.

10. The refrigerator of claim 1, wherein the door comprises:

a purified-water passage through which purified water to be dispensed from the dispenser flows;

a purified-water valve to control discharge of the purified water from the purified-water passage; and a dispensing passage to discharge the purified water, and wherein the water discharge passage has a diameter less than a diameter of the dispensing passage.

11. The refrigerator of claim 1, wherein the hot water tank is disposed below the dispenser, and at least a portion of the water discharge passage extends upward from the hot water tank to the dispenser.

12. The refrigerator of claim 1, wherein the controller determines whether preheating is necessary when a hot water dispensing command is input through the input and operates the heater to preheat the water within the hot water tank in a state in which the water inflow valve and the water discharge valve are closed when it is determined that the preheating is necessary.

13. The refrigerator of claim 1, wherein the input is provided in the door.

14. A refrigerator, comprising:

a cabinet to define a storage space;

a door to open and close the storage space;

a dispenser provided in the door to dispense hot water;

a hot water tank through which water flows to heat water introduced into the door;

a heater provided in the door to heat the hot water tank;

a water inflow passage through which water is supplied to the hot water tank;

a water discharge passage to guide hot water discharged from the hot water tank to the dispenser;

a first flow rate sensor provided in the water inflow passage to measure a flow rate of water flowing through the water inflow passage;

a water inflow valve provided in the water inflow passage to adjust a flow of water in the water inflow passage;

a water discharge valve provided in the water discharge passage;

an input provided to input a temperature of the hot water to be dispensed and a hot water dispensing command; and a controller to control the water inflow valve and the water discharge valve, wherein the controller turns off the water inflow valve and the water discharge valve in a hot water dispensing standby state and turns on the water inflow valve and the water discharge valve in a hot water dispensing process, and wherein the controller determines whether preheating is necessary when a hot water dispensing command is input through the input and operates the heater to preheat the water within the hot water tank in a state in which the water inflow valve and the water discharge valve are closed when the controller determines that the preheating is necessary.

15. The refrigerator of claim 14, wherein, when the hot water dispensing is finished, the controller turns off the water discharge valve after turning off the water inflow valve.

16. The refrigerator of claim 14, further comprising a pressure reducing valve provided in the door to reduce a pressure of the water flowing through the water inflow passage, wherein the first flow rate sensor is disposed in a passage between the pressure reducing valve and the hot water tank so that water passing through the pressure reducing valve passes through the first flow rate sensor, and wherein the water inflow valve is disposed in a passage between the pressure reducing valve and the hot water tank in the water inflow passage.

17. The refrigerator of claim 14, further comprising a flow rate adjustment valve provided in the water inflow passage to adjust a flow rate of water introduced into the hot water tank, wherein the controller controls the flow rate adjustment valve on a basis of the flow rate detected by the first flow rate sensor.

18. The refrigerator of claim 17, further comprising:

a water inflow temperature sensor to detect a temperature of water flowing through the water inflow passage; and a water discharge temperature sensor to detect a temperature of water flowing through the water discharge passage, wherein the controller controls the flow rate adjustment valve on a basis of the temperature detected by the water inflow temperature sensor, the flow rate detected by the first flow rate sensor, the temperature detected by the water discharge temperature sensor, and a set target temperature.

19. The refrigerator of claim 14, wherein at least a portion of the hot water tank is made of a magnetic material, and the heater is provided as a coil and disposed to face the hot water tank at an outside of the hot water tank so as to heat water flowing in the hot water tank.

20. The refrigerator of claim 14, further comprising:

a purified-water passage through which purified water to be dispensed from the dispenser flows, provided in the door, wherein the water inflow passage is branched from the purified-water passage; and a second flow rate sensor provided in the cabinet to detect a flow rate of water flowing through the purified-water passage.

* * * * *